US009220936B2

(12) United States Patent
Mabry, Jr. et al.

(10) Patent No.: US 9,220,936 B2
(45) Date of Patent: Dec. 29, 2015

(54) DEVICE FOR CARRYING AN APPARATUS FOR DISCHARGING A FIRE EXTINGUISHING AGENT AND METHOD THEREFOR

(71) Applicants: James A. Mabry, Jr., Anthem, AZ (US); Danny Kleitsch, Scottsdale, AZ (US); Thomas Smith, Paradise Vallye, AZ (US)

(72) Inventors: James A. Mabry, Jr., Anthem, AZ (US); Danny Kleitsch, Scottsdale, AZ (US); Thomas Smith, Paradise Vallye, AZ (US)

(73) Assignee: All Clear Fire Systems, LLC, Phoenix, AZ (US)

( * ) Notice: Subject to any disclaimer, the term of this patent is extended or adjusted under 35 U.S.C. 154(b) by 216 days.

(21) Appl. No.: 14/079,470

(22) Filed: Nov. 13, 2013

(65) Prior Publication Data

US 2015/0129247 A1 May 14, 2015

(51) Int. Cl.

| | |
|---|---|
| ***A62C 25/00*** | (2006.01) |
| ***A62C 27/00*** | (2006.01) |
| ***A62C 33/04*** | (2006.01) |
| ***A62C 33/00*** | (2006.01) |

(52) U.S. Cl.

CPC ..... *A62C 33/04* (2013.01); *A62C 33/00* (2013.01)

(58) Field of Classification Search

CPC .... A62C 33/04; A62C 25/005; A62C 11/005; A62C 13/64; A62C 13/12; B05B 15/061; B05B 7/2475

USPC ..... 239/525, 526, 152; 169/30, 76, 88

See application file for complete search history.

(56) References Cited

U.S. PATENT DOCUMENTS

| | | | | |
|---|---|---|---|---|
| 2,105,903 | A * | 1/1938 | Clizbe et al. | 239/512 |
| 3,802,511 | A * | 4/1974 | Good, Jr. | 169/30 |
| 6,305,619 | B1 * | 10/2001 | Thurn | 239/337 |
| 6,619,566 | B2 * | 9/2003 | Gressett et al. | 239/296 |
| 6,969,016 | B2 * | 11/2005 | Kusama et al. | 239/600 |
| 7,195,181 | B2 * | 3/2007 | Steingass et al. | 239/581.1 |

* cited by examiner

*Primary Examiner* — Davis Hwu
(74) *Attorney, Agent, or Firm* — Venjuris, P.C.

(57) ABSTRACT

A device for carrying an apparatus for discharging a fire extinguishing agent has a frame member. A leg member extends out and away from a bottom section of the frame member. The leg member is dimensioned to be inserted through an opening formed in the hose attachment.

9 Claims, 20 Drawing Sheets

DEVICE FOR CARRYING AN APPARATUS FOR DISCHARGING A FIRE EXTINGUISHING AGENT AND METHOD THEREFOR

RELATED APPLICATIONS

The present application is related to U.S. patent application entitled, "ELECTRONIC APPARATUS FOR HOSE ATTACHMENT TO ENHANCE VISIBILITY, COMMUNICATION, ATMOSPHERIC MONITORING, EARLY DETECTION AND WARNING FOR FIRE FIGHTER SCENE SAFETY AND METHOD THEREFOR", filed Oct. 31, 2012, and having U.S. Ser. No. 13/665,618 in the name of the James A. Mabry Jr. and Danny Kleitsch. This patent application further is related to U.S. Provisional Application No. 61/849,210, filed Jan. 22, 2013, entitled "KNOBGRIP™, CONVERTIBLE HANDLE FOR KNOBLITE™, ELECTRONIC APPARATUS FOR FIRE HOSE ATTACHMENT, TO ENHANCE HANDS-FREE FUNCTION, UTILITY, VISIBILITY, COMMUNICATION, ATMOSPHERIC MONITORING, AND SCENE SAFETY FOR FIRE FIGHTERS AND OTHER EMERGENCY RESPONDERS OPERATING IN THE HOT ZONE" in the name of James Mabry Jr., Danny Kleitsch, and Thomas Smith, and which is incorporated herein by reference in its entirety, and U.S. Provisional Application No. 61/957,954, filed Jul. 16, 2013, entitled "KNOBLITE™ UNIVERSAL, UNIVERSAL PLATFORM TO ENHANCE VISIBILITY, COMMUNICATION, ATMOSPHERIC METERING/MONITORING, PERSONAL METERING/MONITORING, GLOBAL POSITIONING, EARLY DETECTION AND WARNING FOR FIRST RESPONDER/FIRE FIGHTER SCENE SAFETY AND WORLDWIDE POPULATION PROTECTION" in the name of James Mabry Jr., Danny Kleitsch, and Thomas Smith, and which is incorporated herein by reference in its entirety. The present patent application claims the benefit under 35 U.S.C. §119(e).

BACKGROUND

This invention generally relates to firefighting equipment and more particularly pertains to a new illuminated fire hose, fire engine, fire ladder truck, and individual fire fighter tool attachment for providing a portable, optional light source for a fire hose, fire engine, fire ladder truck, and individual fire fighter that illuminates a target or a pathway as well as provide video monitoring capability and sensors for indicating/monitoring current conditions and warning systems to alert fire fighters of hazardous conditions and assist in the location of lost or incapacitated fire fighters.

Today's fire fighters are asked to fill many roles and operate on diverse emergency scenes. These scenes include structural fire fighting, wild land fire fighting, vehicular accidents, technical rescues, hazardous material exposures, and emergency medical incidents. All of these incident scenes present unique and different challenges. One of the commonalities is the utilization by fire fighters of hand lines with various extinguishing agents on almost every scene. Fire fighters use these hand lines not only to extinguish fire, but to protect themselves and the citizens they are called to serve, at any scene day or night. Fire fighters are required to carry an inordinate number of hand tools to include personal flashlights, scene lighting, extrication tools, fire fighting tools, medical equipment, and radios. The complexity of the work environment and minimum staffing on most emergency scenes makes it virtually impossible for crews to be adequately prepared and carry all the tools they need for any one situation. The necessity to return to on scene fire vehicles to retrieve additional equipment is time consuming and dangerous. Fire fighters need a new option to lessen their work loads, enhance visibility, improve communication, identify unseen hazards, provide early warning, and make the operating environment a more efficient and safer place to work.

Therefore, it would be desirable to provide a device and method that overcomes the above problems. The device and method would provide a hands-free tool and carrying device to assist fire crews involved in search, rescue, and fire suppression efforts. The device and method would provide a lighting source and video monitoring capability to be used in fire fighting operations that provides adequate lighting for engaged fire fighters and remote video monitoring capability by fire ground supervisors to promote safe operations inside or outside a structure. An example of inside operations would be a commercial structure fire, apartment fire, or house fire. An example of outside operations would be a wild land fire or illuminating the scene of a vehicle accident. The device and method would provide a high-intensity light source and video monitoring capability that may be affixed to any nozzle on a hand line of a fire hose, water discharge outlet of a fire engine/ladder truck, or individually carried by a fire fighter with a carrying device.

The device and method would provide for atmospheric monitoring to detect hazardous materials in the work environment. The device and method would provide for personal health monitoring of individual fire fighters to promote early treatment for sickness or injury. The device and method would act as an early warning device for structure collapse, self-contained breathing apparatus air management, or lost/incapacitated fire fighter. The device and method would provide these benefits and enhanced communication through a hands-free, voice free lighting system easily visible to the fire fighters on the face of the device with an integrated video monitoring capability able to provide real time video presentation to incident commanders at locations distant from the engaged fire fighters. Command units on the perimeter of the emergency scene would be constantly apprised of fire fighting operating conditions and could communicate instantly the necessity to change strategy, withdraw crews from dangerous situations, or effect a rescue.

SUMMARY

A device for attachment to a fire hose, water discharge outlet on a fire engine/ladder truck, or hand carried by an individual fire fighter by means of a lifting and carrying tool that enhances fire ground visibility by means of a lighting source, enhances fire ground communication by means of a video monitoring source, and enhances fire fighter safety by means of an atmospheric/biological metering/monitoring/warning source. All of the enhancements are contained in one, lightweight unit with the ability to be deployed anywhere on the fire scene.

A device for carrying an apparatus for discharging a fire extinguishing agent has a frame member. A leg member extends out and away from a bottom section of the frame member. The leg member is dimensioned to be inserted through an opening formed in the hose attachment.

A device for carrying an apparatus for discharging a fire extinguishing agent has a frame member. A handle is formed on a top section of the frame member. A leg member extends out and away from a bottom section of the frame member. The leg member is dimensioned to be inserted through an opening formed in the hose attachment. An end cap is removably coupled to the leg member for securing the hose attachment to the device.

A device for carrying an apparatus for discharging a fire extinguishing agent has a frame member. A locking device is used for securing the apparatus to the frame member.

The features, functions, and advantages may be achieved independently in various embodiments of the disclosure or may be combined in yet other embodiments.

BRIEF DESCRIPTION OF THE DRAWINGS

Embodiments of the disclosure will become more fully understood from the detailed description and the accompanying drawings, wherein.

DETAILED DESCRIPTION

Figure 1:
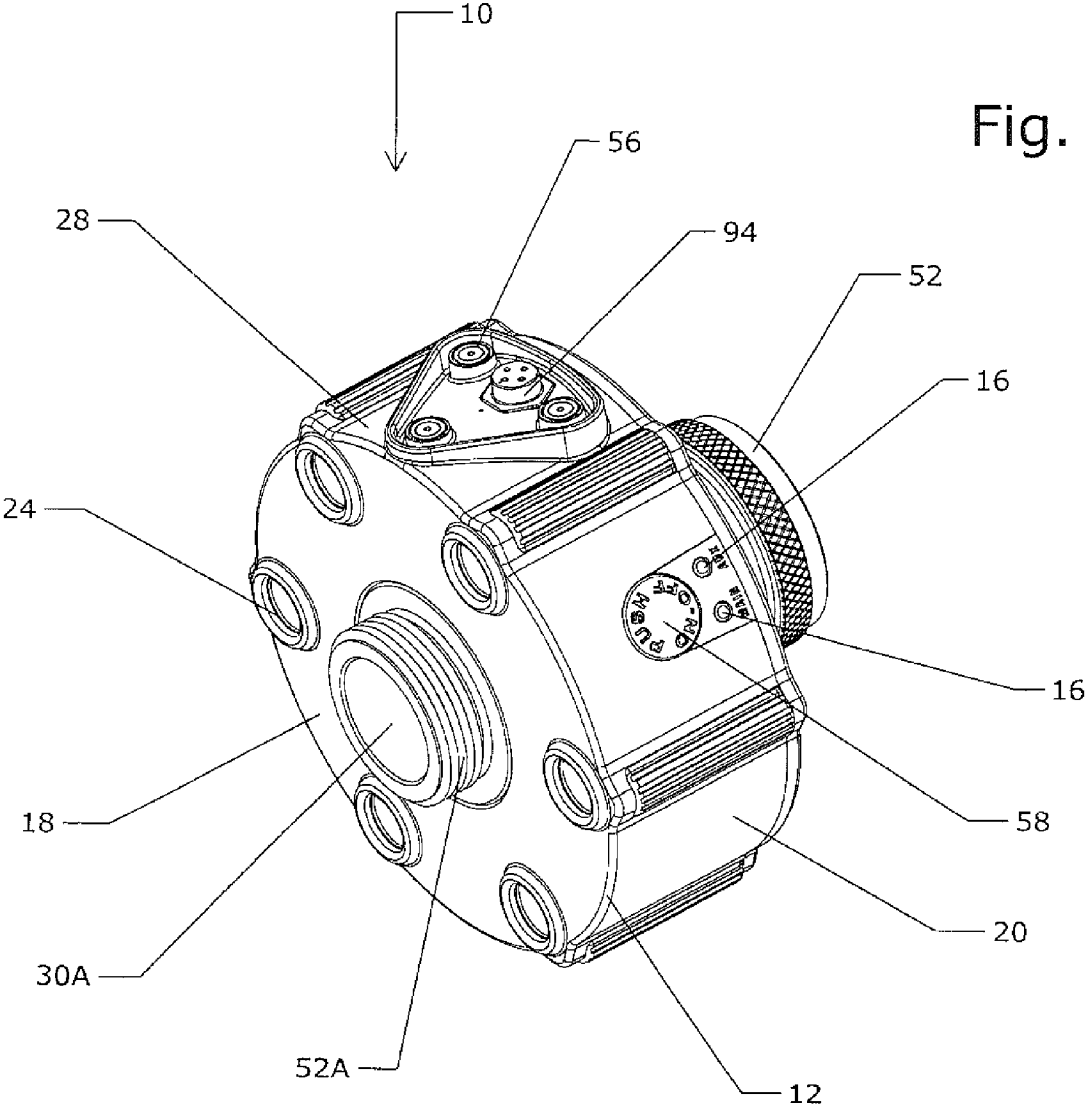
FIG. 1 is a first elevated perspective view of the light source device of the present invention.
Figure 2:
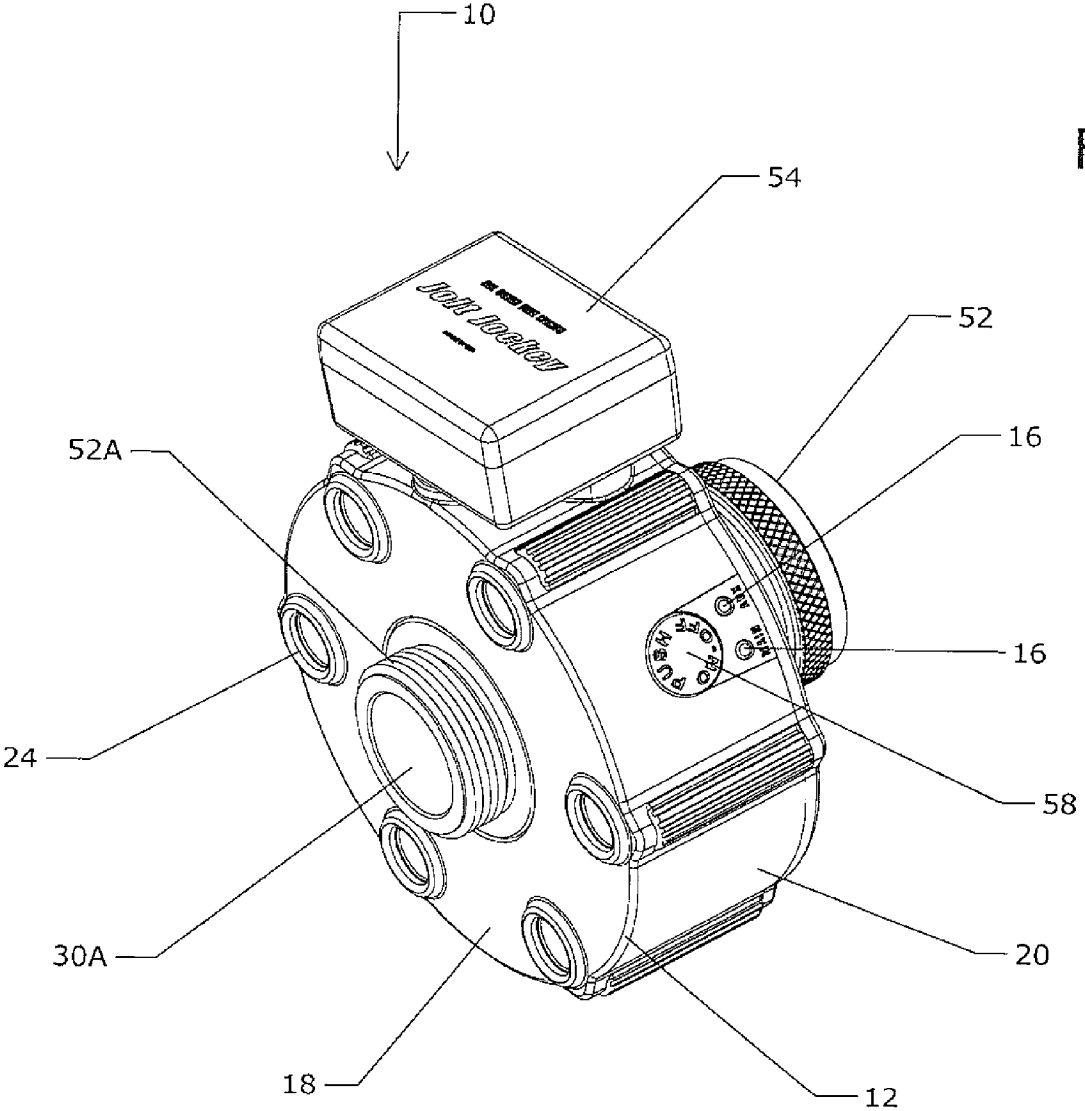
FIG. 2 is the first elevated perspective view of the light source device in accordance with FIG. 1 with a battery pack attached thereto.
Figure 3:
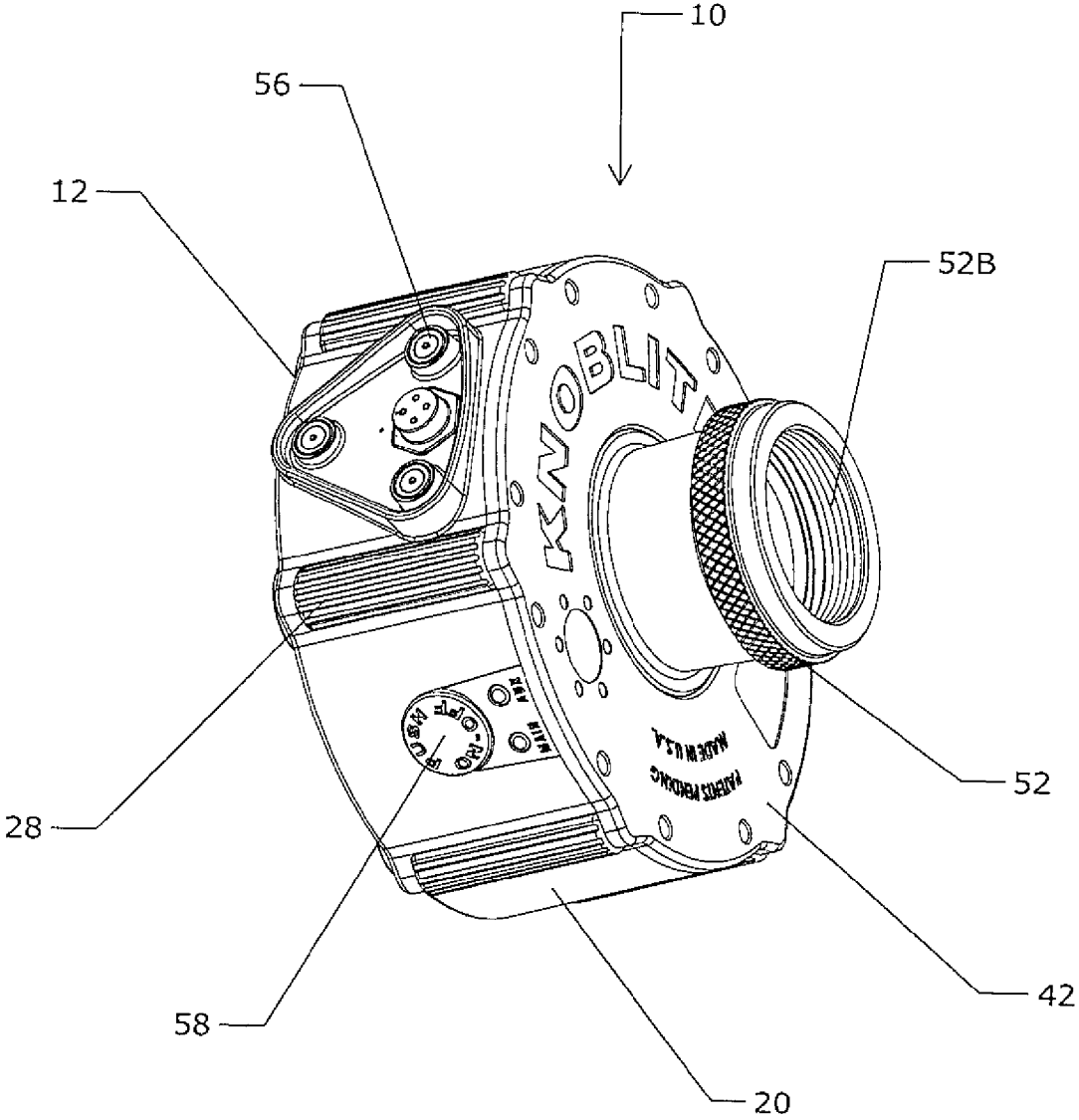
FIG. 3 is a second elevated perspective view of the light, source device of the present invention.
Figure 4:
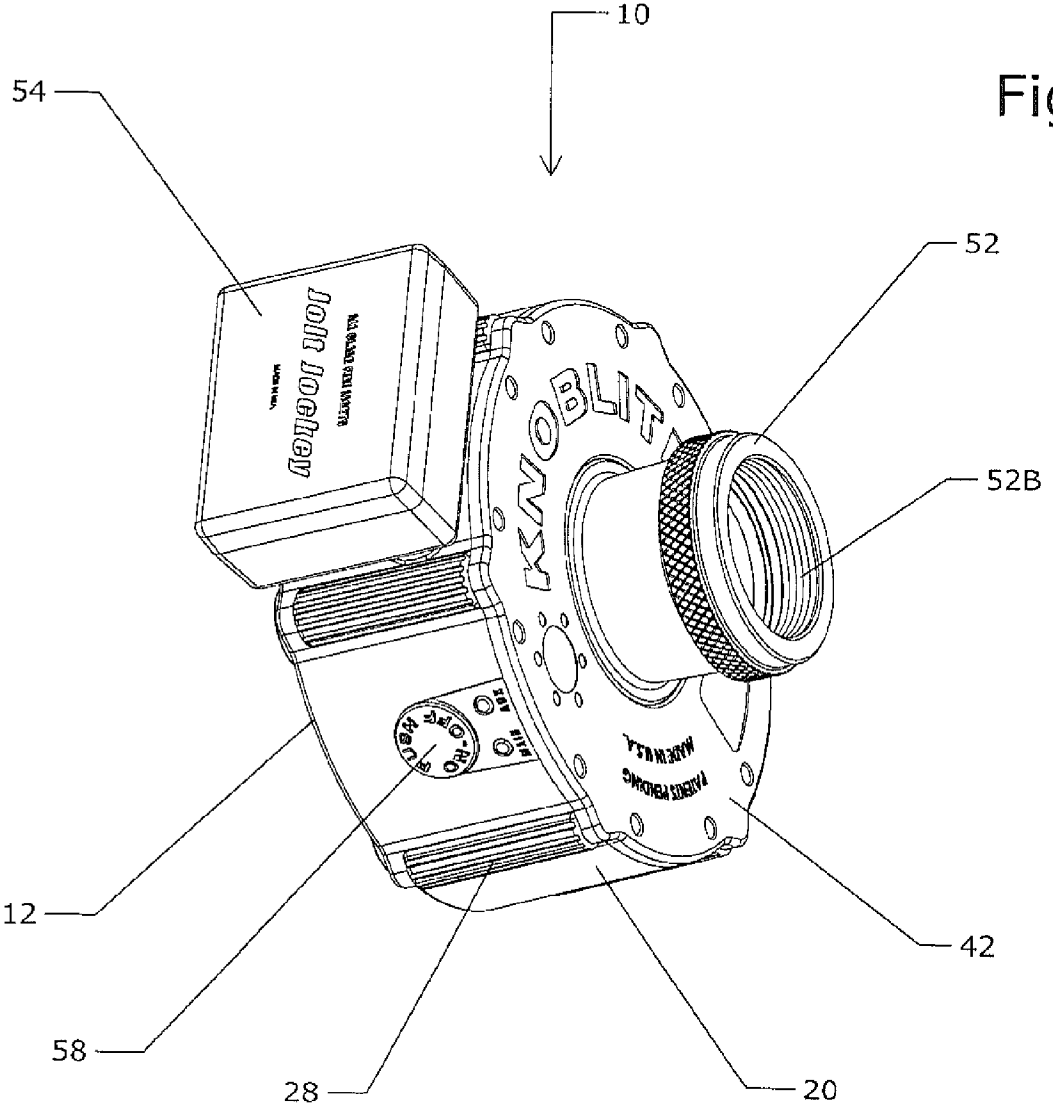
FIG. 4 is the second elevated perspective view of the light source device in accordance with FIG. 2 with the battery pack attached thereto.
Figure 5:
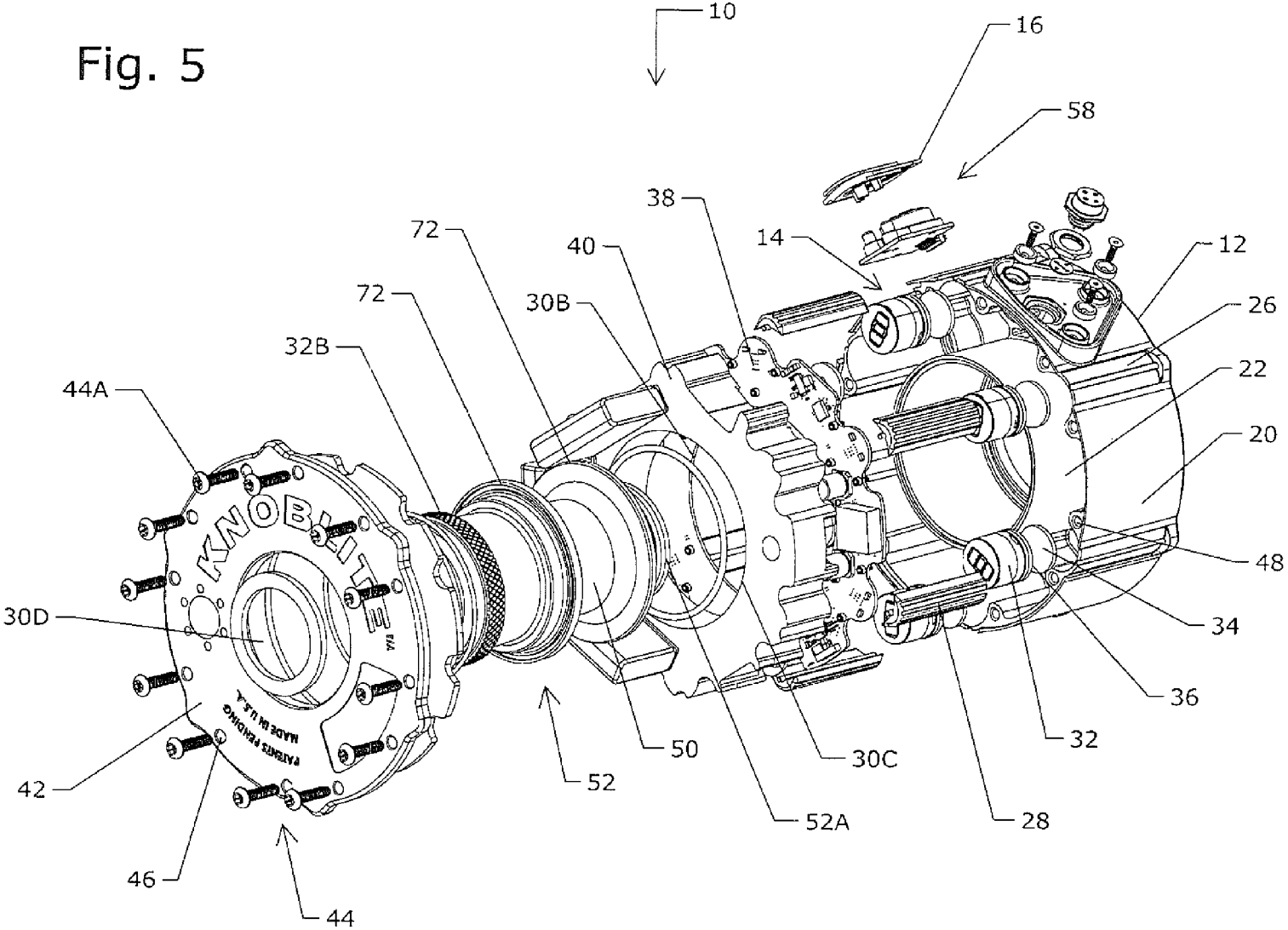
FIG. 5 is a first exploded side view of the light source device of the present invention.
Figure 6:
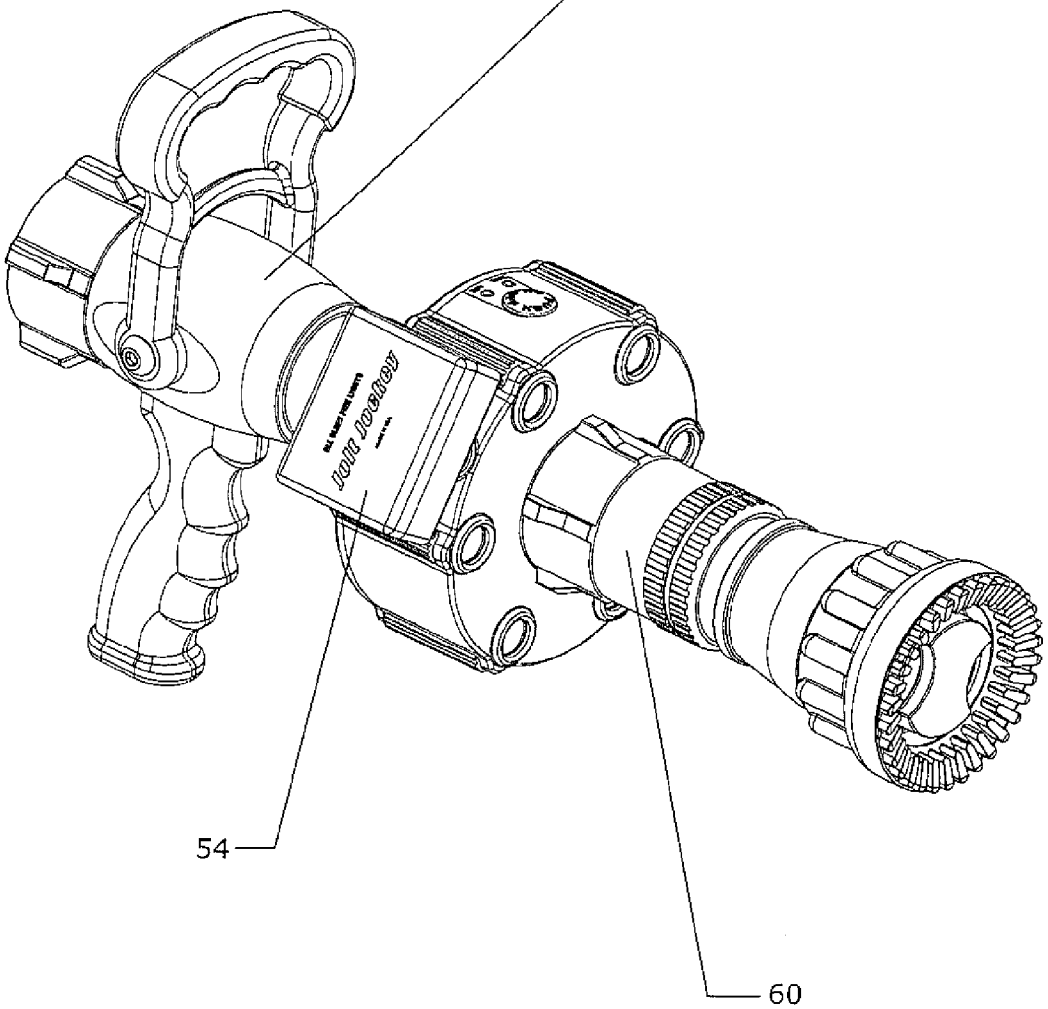
FIG. 6 is a first elevated perspective view of the light source device with a battery pack attached to a fire hose.
Figure 7:
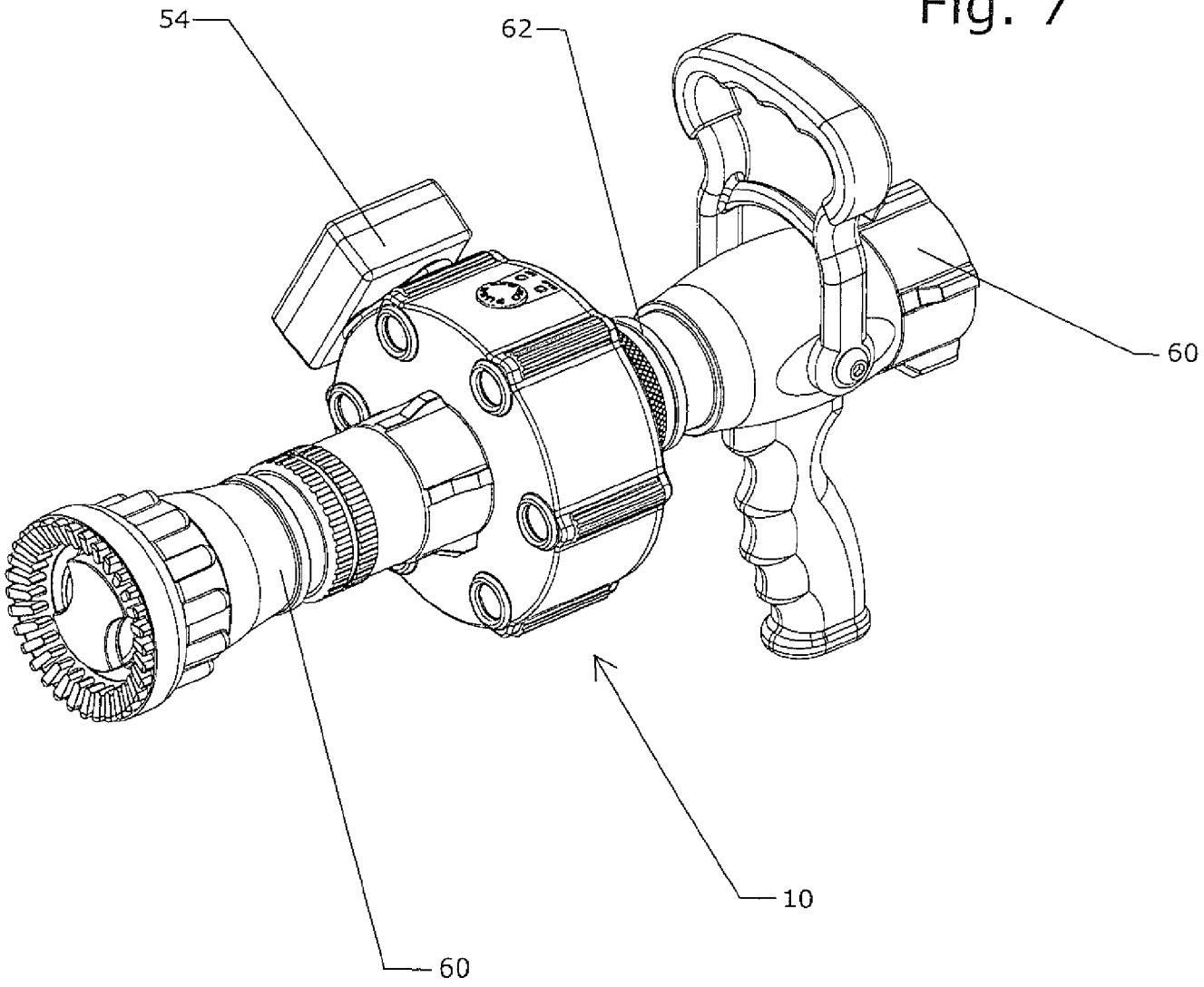
FIG. 7 is a second elevated perspective view of the light source device with a battery pack attached to a fire hose.
Figure 8:
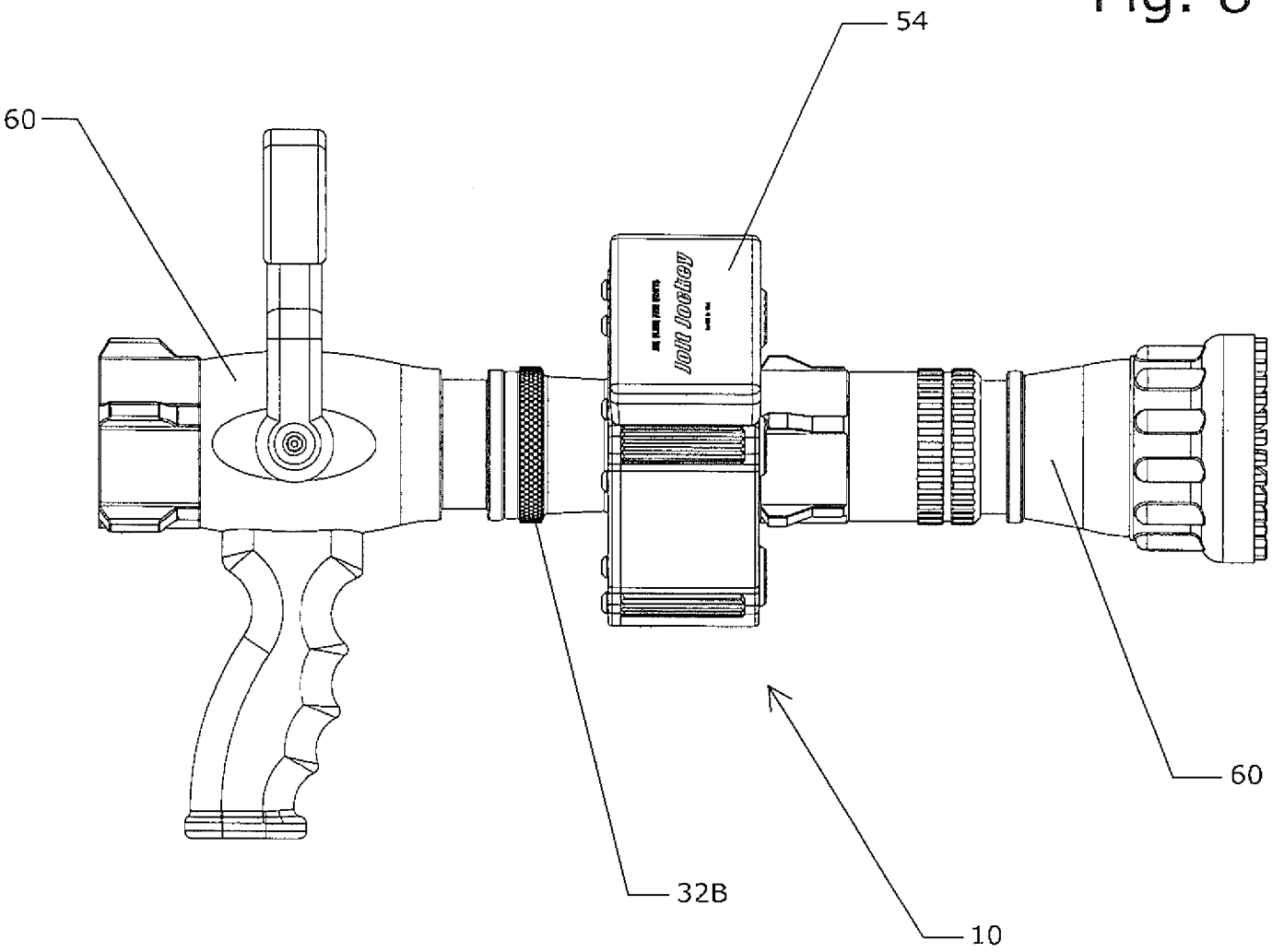
FIG. 8 is a side view of the light source device with a battery pack attached to a fire hose.
Figure 9:
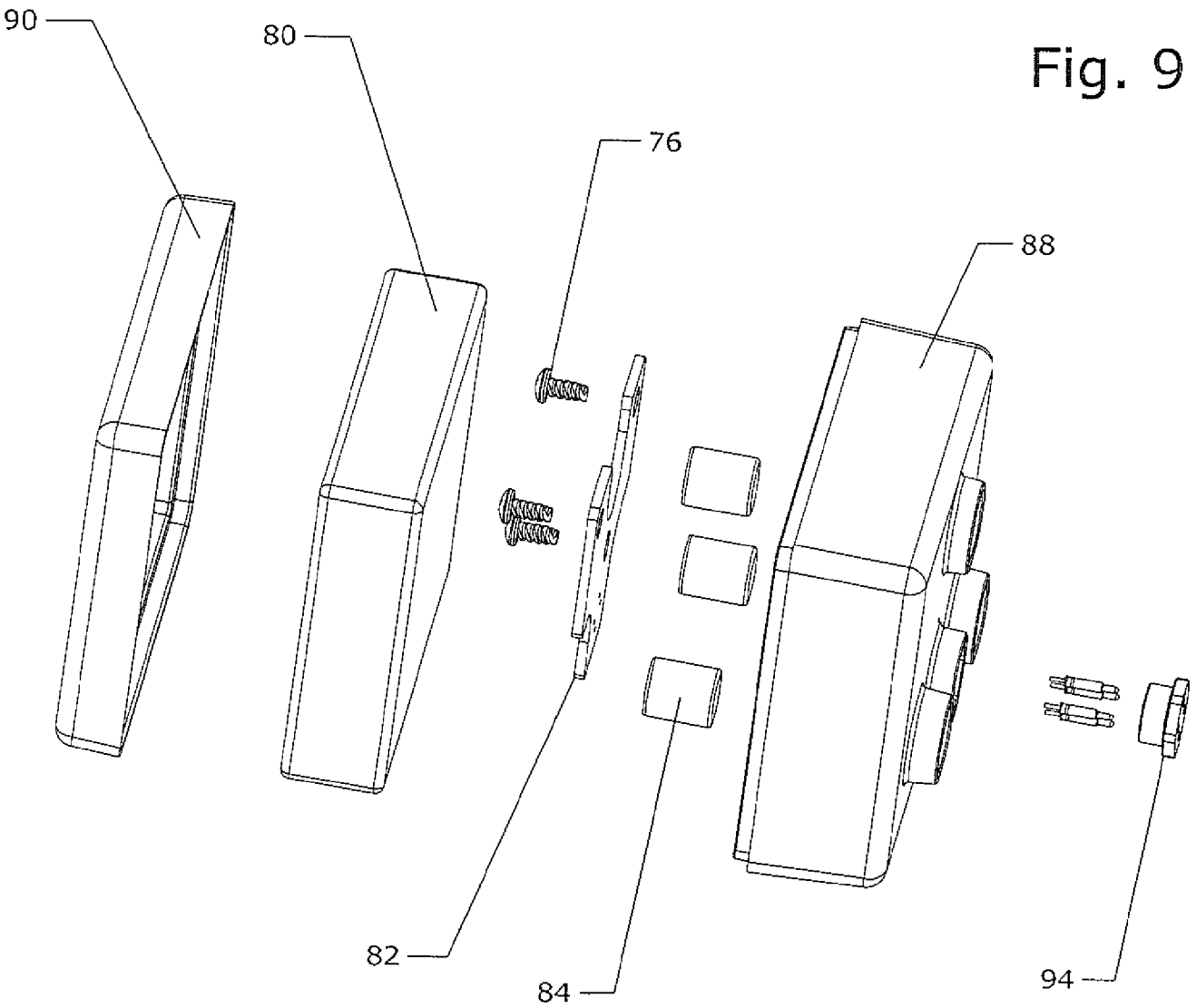
FIG. 9 is an exploded perspective view of the battery pack used with the light source device of the present invention.
Figure 10:
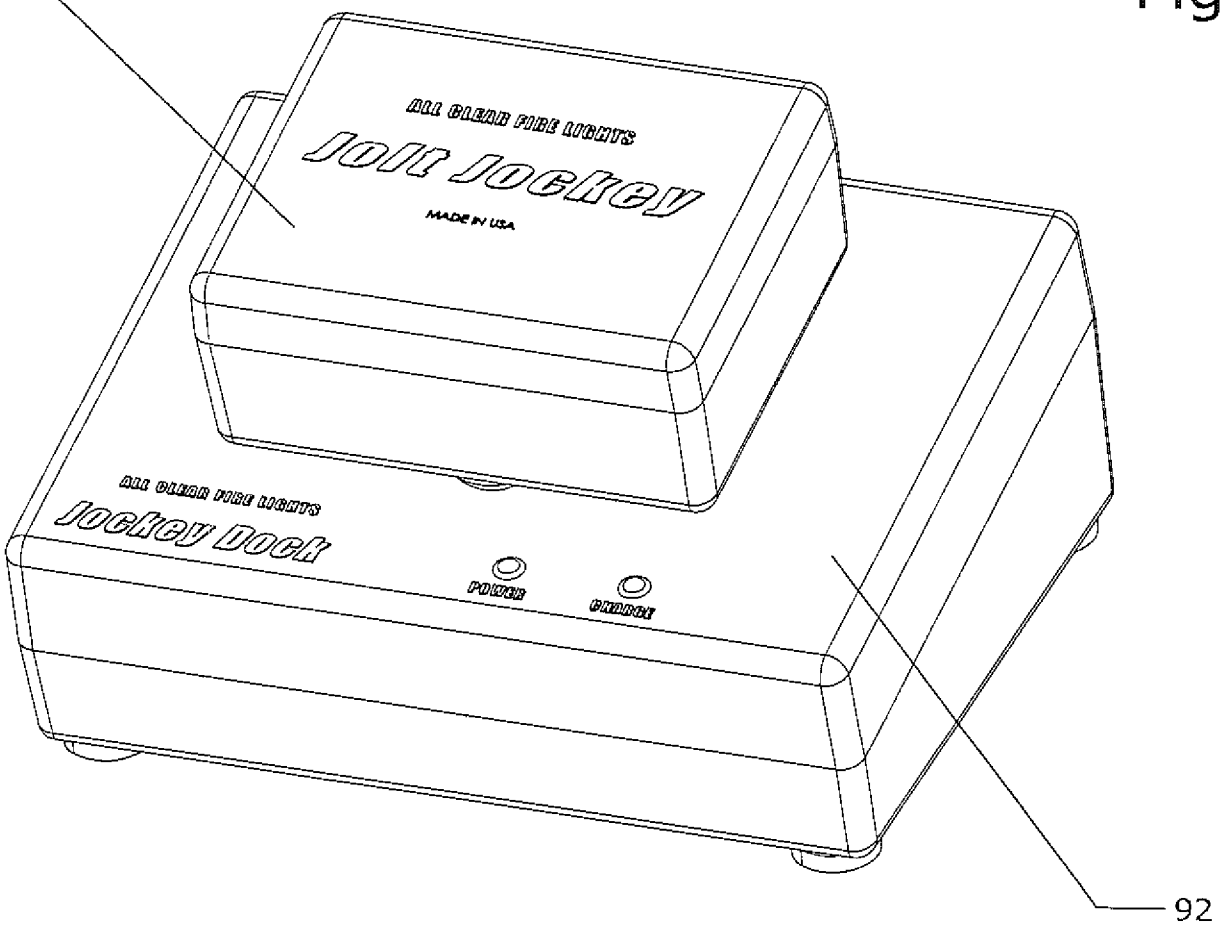
FIG. 10 is an elevated perspective view of the battery pack used with the light source device of the present invention attached to a charger.
Figure 11:
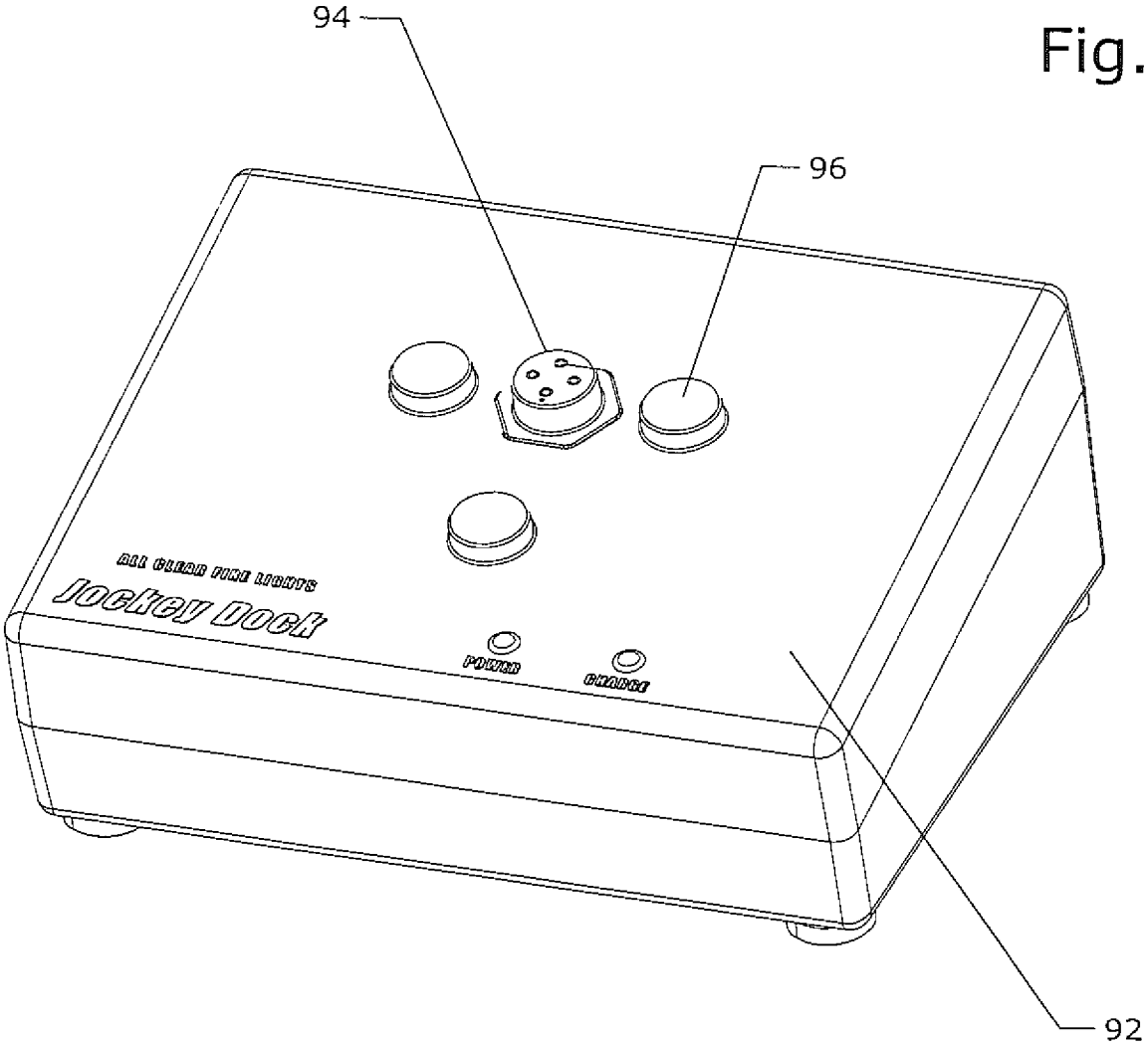
FIG. 11 is an elevated perspective view of the charger used with the battery pack.
Figure 12:
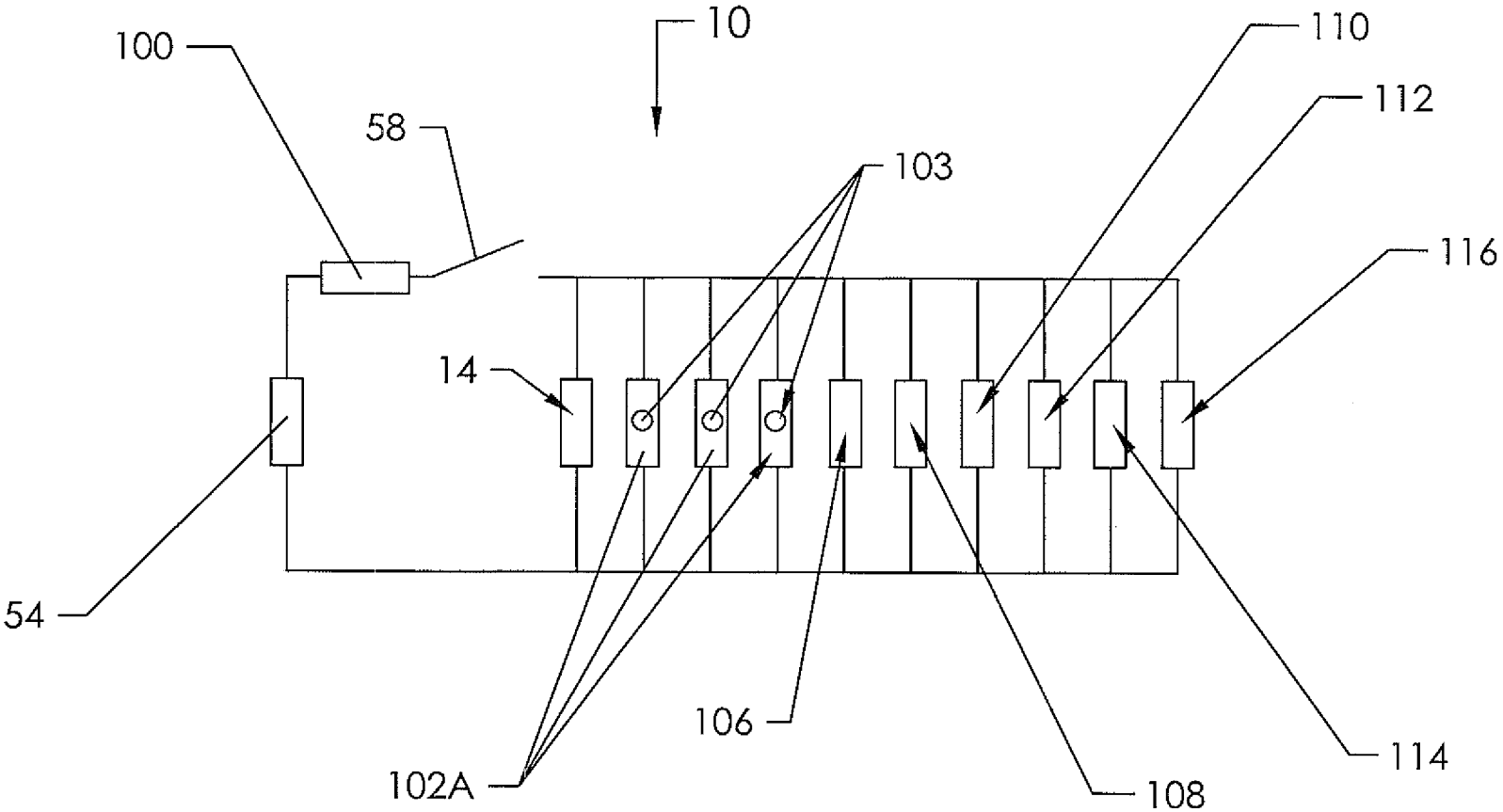
FIG. 12 is a block diagram of the electronic circuit used in the present invention.

Referring to the Figures, a light source device (hereinafter device 10) of the present invention is shown. The device 10 may be attached to any fire hose/nozzle, water discharge outlet on a fire engine/ladder truck or carried by an individual fire fighter by means of a lifting and carrying device as will be described below. The device 10 may provide future generations of fire fighters with a means that attaches to fire nozzles and fire hose couplings that may allow fire fighters to advance hose lines into structure fires, wild land fires, vehicle fires, hazardous material environments, and other hazardous situations without the necessity of these fire fighters assuming the burden of carrying hand held flashlights on their person. The device 10 may further provide video monitoring capability for incident commanders at remote locations on the fire scene to evaluate the work efforts and conditions being experienced by fire fighters engaged in fire fighting operations. The device 10 may further provide visual indicators about current operating conditions for the firefighters as will be discussed below.

The device 10 may be configured to securely fit between a fire nozzle 60 and fire hose coupling 62. Alternatively, the device 10 may be positioned between two fire hose couplings 62. Additionally, the device 10 may be attached to a water discharge outlet on a fire engine/ladder truck. The device 10 is designed to not impede the flow of extinguishing agent or to be obstructive when moved around the fire ground when the device 10 is positioned between the fire nozzle 60 and fire hose coupling 62 or between two fire hose couplings 62. Likewise, the device 10 will not impede the flow of extinguishing agent when attached to a water discharge outlet on a fire engine/ladder truck.

The device 10 may have a housing 12. The housing 12 may be used to store and house a plurality of lighting and video fixtures 14. The lighting and video fixtures 14 may be used to illuminate the fire ground and guide the fire fighter as he/she advances the hose lines. The housing 12 may further be used to store and house one or more visual indicators 16. The visual indicators 16 may be used to provide warnings to the firefighters about current operating conditions. The housing 12 may be constructed of a material that is lightweight, durable, heat resistant, cold resistant, water resistant, and able to function flawlessly in the demanding environments occupied by fire fighters in the course of their work.

The housing 12 may be formed of different geometric shapes. In the present embodiment, the housing 12 is circular in shape. A circular shape housing 12 may provide the least amount of resistance when moving the fire house with the device 10 attached. However, the circular shape is shown as one embodiment, and should not be seen in a limiting manner.

The housing 12 may be comprised of a front plate 18. A side wall 20 may be formed around a perimeter of the front plate 18. The side wall 20 may be formed to extend up from the front plate 18 there by forming a hollow interior section 22 of the housing 12. The interior section 22 may be used to store and house the plurality of lighting and video fixtures 14 as well as electronics for one or more visual indicators 16.

One or more light openings 24 may be formed through the front plate 18. The light openings 24 may be formed around the perimeter of the front plate 18. The light openings 24 may be used to position the one or more lighting and video fixtures 14 within the housing 12. One or more light slots 26 may also be formed within the side wall 20. The one or more light slots 26 may be formed next to and adjacent a corresponding light opening 24. The light slots 26 may be used to allow easy removal of a corresponding lighting and video fixture 14. A lighting fixture plate 28 may be positioned within each light slot 26 to secure the lighting and video fixture 14 within the light slot 26 and corresponding light opening 24. The lighting fixture plate 28 may be designed to be pressure fitted within the light slots 26. Thus, by applying pressure to the lighting fixture plate 28, one may be able to release the lighting fixture plate 28 from within the light slots 26, thereby allowing one to remove the corresponding lighting and video fixture 14.

As stated above, a plurality of lighting and video fixtures 14 are positioned within the housing 12. As shown in the Figures, each lighting and video fixture 14 may be comprised of a light source unit 32. Each light source unit 32 may be a high-intensity, LED lighting fixture that may be able to illuminate the fire ground and guide the fire fighter as he/she advances hose lines. A lens 34 may be positioned in front of each light source unit 32. The lens 34 may be used to focus and/or direct the light from the light source unit 32. The lens 34 may also be used to protect the light source unit 32. A lens housing 36 may be used to secure the lens 34 in front of each light source unit 32. A plate member 38 may be used to secure the lighting and video fixture 14 within the interior section 22 of the housing 12.

The housing 12 may have a cover 40. The cover 40 may be positioned over the interior section 22 of the housing 12. Thus, the cover 40 may be used to enclose the housing 12. A locking plate 42 may be used to secure the cover 40 to the housing 12. The locking plate 42 may have one or more securing members 44. The securing members 44 may be used to secure the cover 40 to the housing 12. In accordance with one embodiment, the securing members 44 may be a plurality of screws 44A. As shown in the Figures, one or more openings 46 may be formed around an outer perimeter of the locking plate 42. Each opening 46 may be aligned with a corresponding channel 48 formed on the housing 12. Each channel 48 may be formed on the side wall 20. Each channel 48 may be threaded so as to engage a corresponding screw 44A.

The front plate 18, the plate member 38, the cover 40, and locking plate 42 may each have a central opening 30A, 30B, 30C and 30D respectively, formed there through. The central openings 30A, 30B, 30C and 30D may be used to allow the extinguishing agent to enter and flow through the housing 12.

A pipe 50 may be positioned through the housing 12. The pipe 50 may be used to allow the extinguishing agent to pass through the housing 12. In accordance with the embodiment depicted in the Figures, the pipe 50 may be positioned through the central openings 30A, 30B, 30C and 30D formed through the front plate 18, the plate member 38, the cover 40, and locking plate 42 respectively. The pipe 50 may be used to allow the extinguishing agent to enter and flow through the housing 12.

The pipe 50 is designed to not impede the flow of extinguishing agent or to be obstructive when moved around the fire ground when the device 10 is positioned between the fire nozzle 60 and fire hose coupling 62 or between two fire hose couplings 62. The pipe 50 may have a coupling 52 located on each end. The coupling 52 may be used to connect the pipe 50 between the fire nozzle 60 and fire hose coupling 62 or between two fire hose couplings 62. The coupling 52 may be a threaded end 52A, a threaded hose coupling 52B, or the like. The above is given as an example and should not be seen in a limiting manner. Other couplings may be used without departing from the spirit and scope of the present invention.

The pipe 50 may further have a pair of ring members 72. A ring member 72 may be positioned on each end of the pipe 50. The ring members 72 may be used to secure the pipe 50 within the housing 12.

The housing 12 may have one or more contacts 56. The contacts 56 may be used to secure a power supply 54 to the housing 12. The power supply 54 may be used to power electronic circuitry 70 stored within the housing 12. The power supply 54 is interchangeable so that a current power supply 54 may be removed, and a fully charged power supply attached to the contacts 56. The power supply 54 may also be a rechargeable power supply.

The Figures show one embodiment of the power supply 54. As may be seen in the Figures, the power supply 54 may have a battery unit 80. The battery unit 80 may be used to supply a DC power source to the electronic circuitry 70. The battery unit 80 may have a contact board 82 attached thereto. One or more securing devices 76 may be used to secure the contact board 82 to the battery unit 80. The contact board 82 may be used to attach a battery contact 84 to the battery unit 80. The battery contact 84 may be used to attach the power supply 54 to contacts 56. This may allow the power supply 54 to attach to the electronic circuitry 70. When in use, the battery contact 84 may contact the contacts 56 to secure the power supply 54 to the housing 12 and to the electronic circuitry 70.

The battery unit 80 may be stored within a battery housing 88. A lid 90 may be attached to the battery housing 88 thereby enclosing the battery unit 80 within the battery housing 88.

In accordance with one embodiment, the battery unit 80 is a rechargeable battery unit. One or more charging pins 92 may be coupled to one of the battery contacts 84. This may allow the charging pins to attach to a charging plug 94 of a recharging unit 92. One or more alignment pins 90 may be formed on the battery housing 88. The alignment pins 90 may be used to align the power supply 54 onto a recharging unit 92 having corresponding alignment pins 96.

The housing 12 may store electronic circuitry 70. The electronic circuitry 70 may be positioned within the interior section 22 of the housing 12. The electronic circuitry 70 may be capable of connecting and operating a myriad of simple systems that perform functions essential to fire fighter safety.

A switch 58 may be coupled to the power supply 54. The switch 58 may be used to activate and deactivate the electronic circuitry 70. The switch 58 may be located on the exterior of the housing 12. The switch 58 may be programmed to "turn on" with a 0.5 second engagement and "turned off" with a 3.0 second engagement to avoid any inadvertent termination of the electronic circuitry 70 during operation. The switch 58 may further double as a "CAP" (conditions, air, people) elapsed time warning light. Fire fighters are taught that 10 minutes of flame impingement on building structural components seriously effect construction integrity and pose serious collapse hazards to fire fighters inside structure. The switch 58 may be an illuminating switch. When activated, the switch 58 may automatically initiate a timer 100. The switch 58 may appear "green" advising fire fighters that they have been inside the "hot zone" for less than 10 minutes. At 10 minutes the switch 54 will begin blinking "red". This will remind fire fighters to address their tactical priorities:

(1) Conditions: re-evaluate the interior conditions of the structure for safety.

(2) Air: check the available air in you and your crew's SCBA bottles.

(3) People: know the location and condition of all your assigned members.

and begin to plan their egress from the structure. At 15 minutes the blinking "red" will become a solid "red". This will provide a "fire fighter off line/MAYDAY" safety feature that will keep the device illuminated to act as a beacon for fire fighters attempting to find the hand line in low visibility environments or locate lost/incapacitated fire fighters. The light function on the switch 56 can again be illuminated by engaging the switch 58 for 0.5 second.

One of the functions of the electronic circuitry 70 may be to provide a high-intensity, LED lighting system able to illuminate the fire ground and guide the fire fighter as he/she advances hose lines. Thus, the lighting and video fixtures 14 are generally coupled to the power supply 54. The lighting and video fixtures 14 may be programmed to automatically turn off at 15 minutes to save on the life of the power supply 54 should the nozzle be unattended and acts as a timer for work cycles. Whether inside a structure, outside on a wild land fire, or on the scene of an auto accident the lighting and video fixtures 14 may have a minimum of two settings, high/low. The choice of light intensity will not affect the light timing as it is independent of the fire fighter choice of light intensity. Timing requirements can be altered or customized per individual fire department specifications and needs.

One or more sensors/alarms 102 may also be coupled to the power supply 54. One of the sensors/alarms 102 may be for example a hazmat monitor 102A. The hazmat monitor 102A may monitor for hazardous materials such as $O_2$, CO, $SO_2$, CN, radiation, LEL (explosion limit), and the like. The listing of the above is given as an example and should not be seen in a limiting manner. The hazmat monitor 102A may be coupled to a visual indicator 103 Thus, when hazmat monitor 102A detects a specified hazardous material, the corresponding visual indicator 103 may illuminate.

The electronic circuitry 70 may further have a receiver/transmitter unit 106. The receiver/transmitter unit 106 may be used to transmit video/data collected from the electronic circuitry 70 to a desired location (i.e., command post, etc.). The receiver/transmitter unit 106 may further be used to receive video/data transmitted by another party. For example, the receiver/transmitter unit 106 may receive a command to evacuate the building transmitted by the command post. In this situation, the receiver/transmitter unit 106 may cause the electronic circuitry 70 to start flashing all visual indicators 103.

The receiver/transmitter unit 66 may further be able to receive and then transmit current health data of the firefighter. For example, a firefighter may wear one or more sensors to monitor the firefighter's health (i.e., heart rate, blood pressure; $O_2$ levels, etc. The information monitored by these sensors may then be collected and transmitted by the receiver/transmitter unit 106 to a desired location (i.e., command post, etc.).

The electronic circuitry 70 may further have a display screen 108. The display screen 108 may be used to display graphical information. For example, the display screen 108 may display information captured by the sensors 102 and or sensors on the firefighters as discussed above. The display screen 108 may display information transmitted by the command post. The above is given as examples of information that may be displayed on the display screen 108. Other information may be displayed without departing from the spirit and scope of the present invention. It should also be noted that the display screen 108 may be used for other purposes than that described above without departing from the spirit and scope of the present invention.

The electronic circuitry 70 may further have a distress button 110. The distress button 110 when activated would alert others that a firefighter is in need of help. The distress button 110 may send a signal which causes all of the lighting and video fixtures 14 to start flashing. The distress button 110 may send a signal to the receiver/transmitter unit 106 which may transmit a signal to a command post that the firefighter is in trouble. The above are given as examples. The distress button 110 when activated may alert others that a firefighter is in need of help in other ways without departing from the spirit and scope of the present invention.

Figure 13:
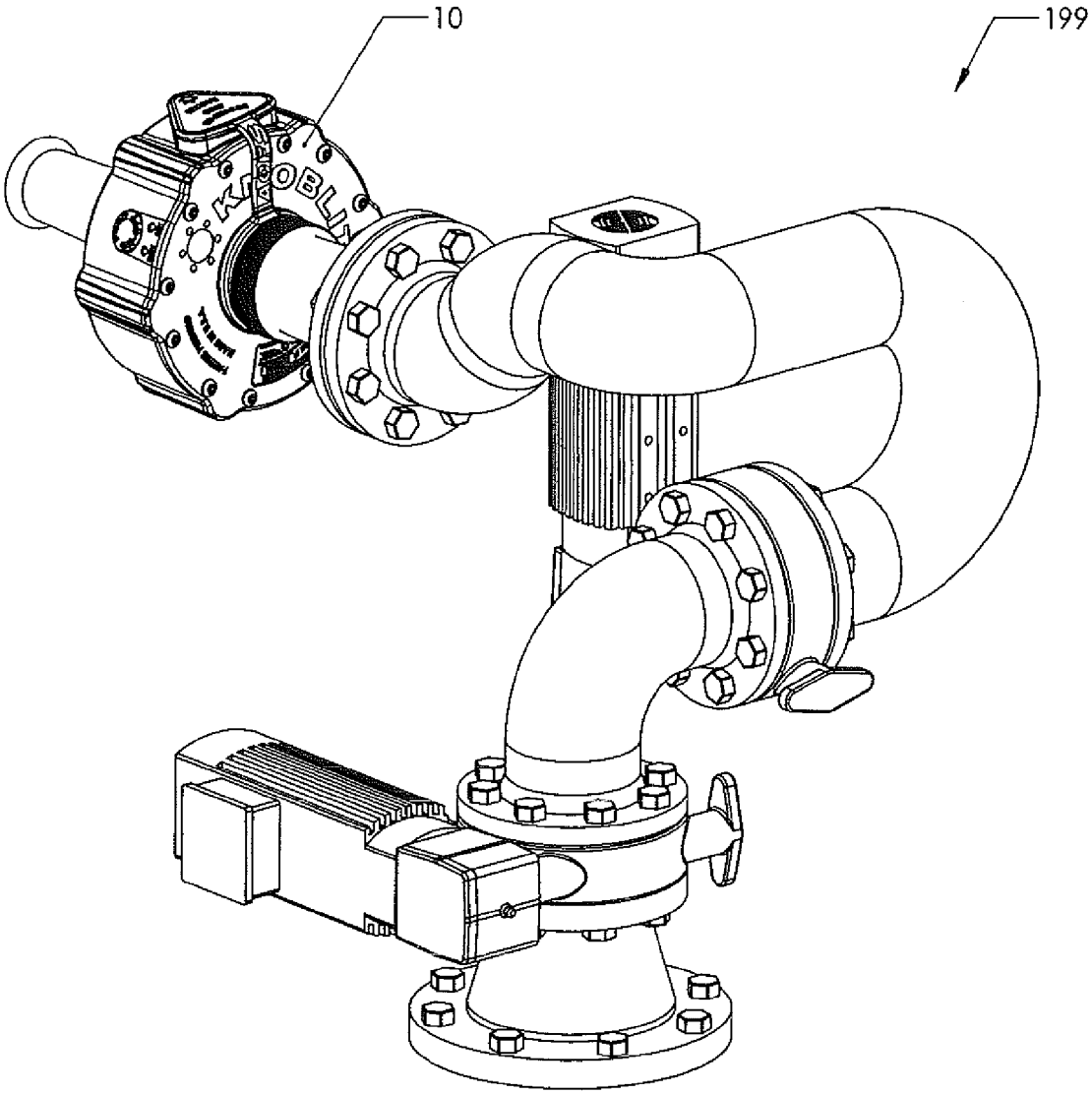
FIG. 13 is a perspective view of the light source device of the present invention attached to a fire engine water gun.
Figure 14:
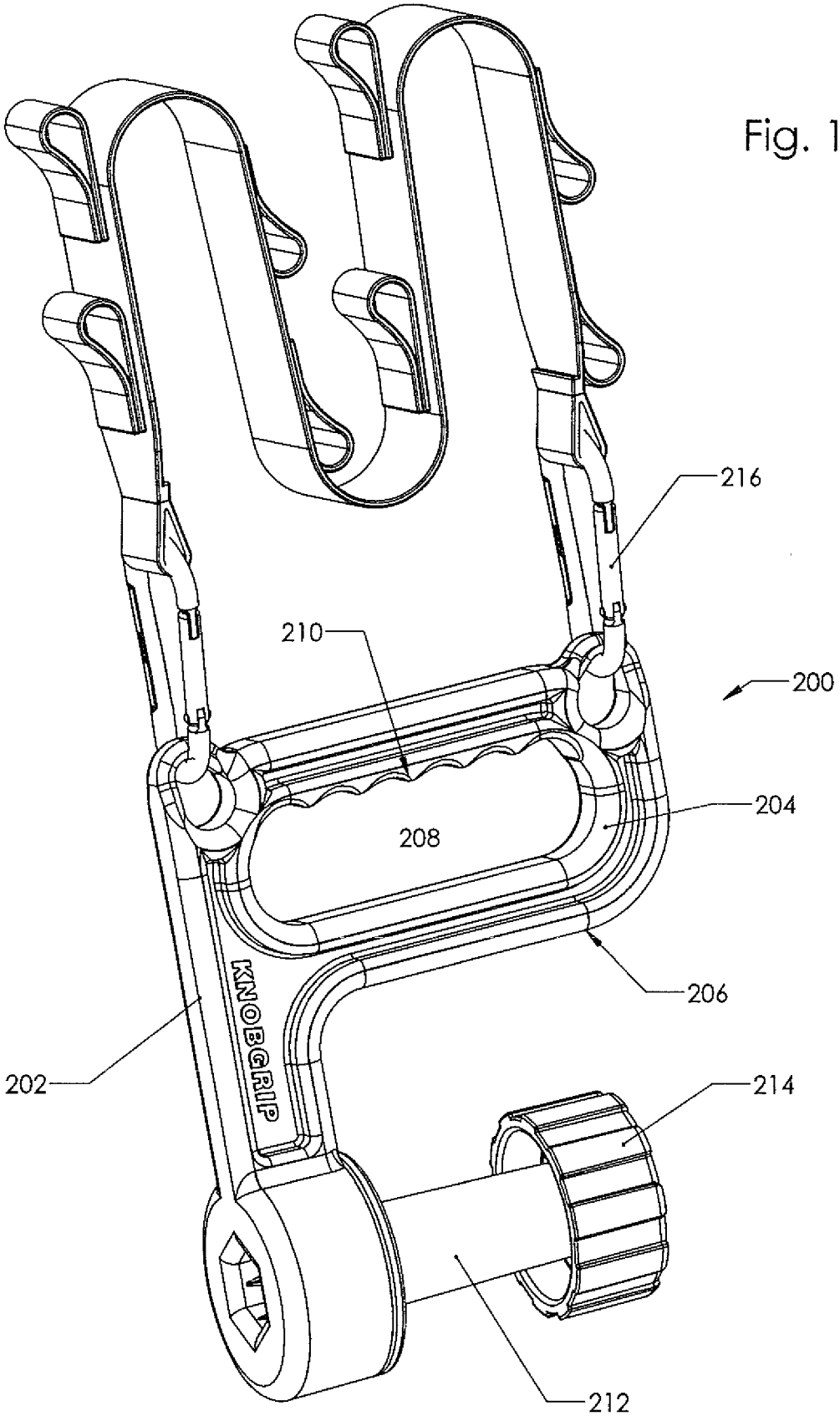
FIG. 14 is a perspective front view of a carrying device used with the light source device.
Figure 15:
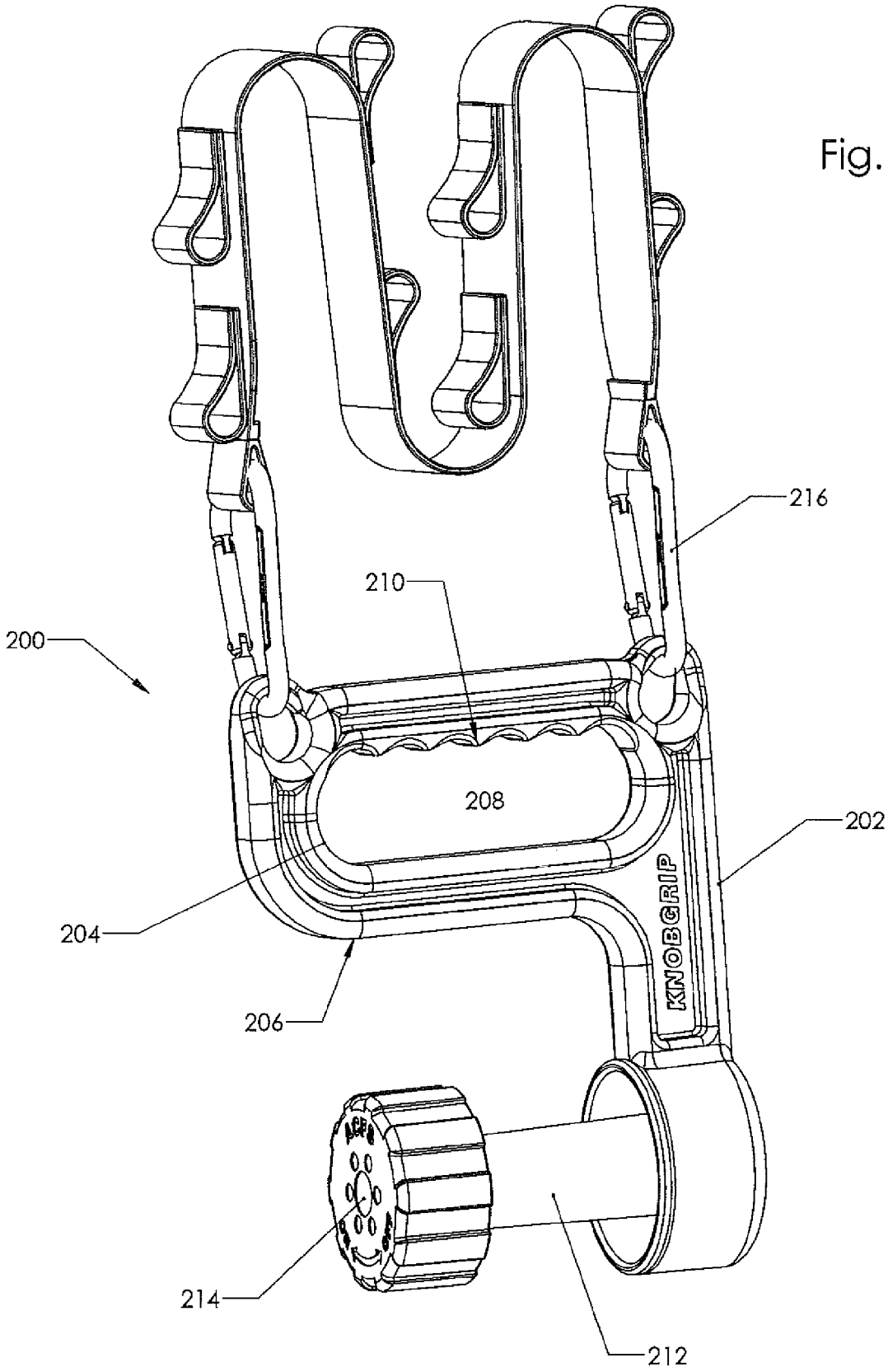
FIG. 15 is a perspective rear view of the carrying device used with the light source device.
Figure 16:
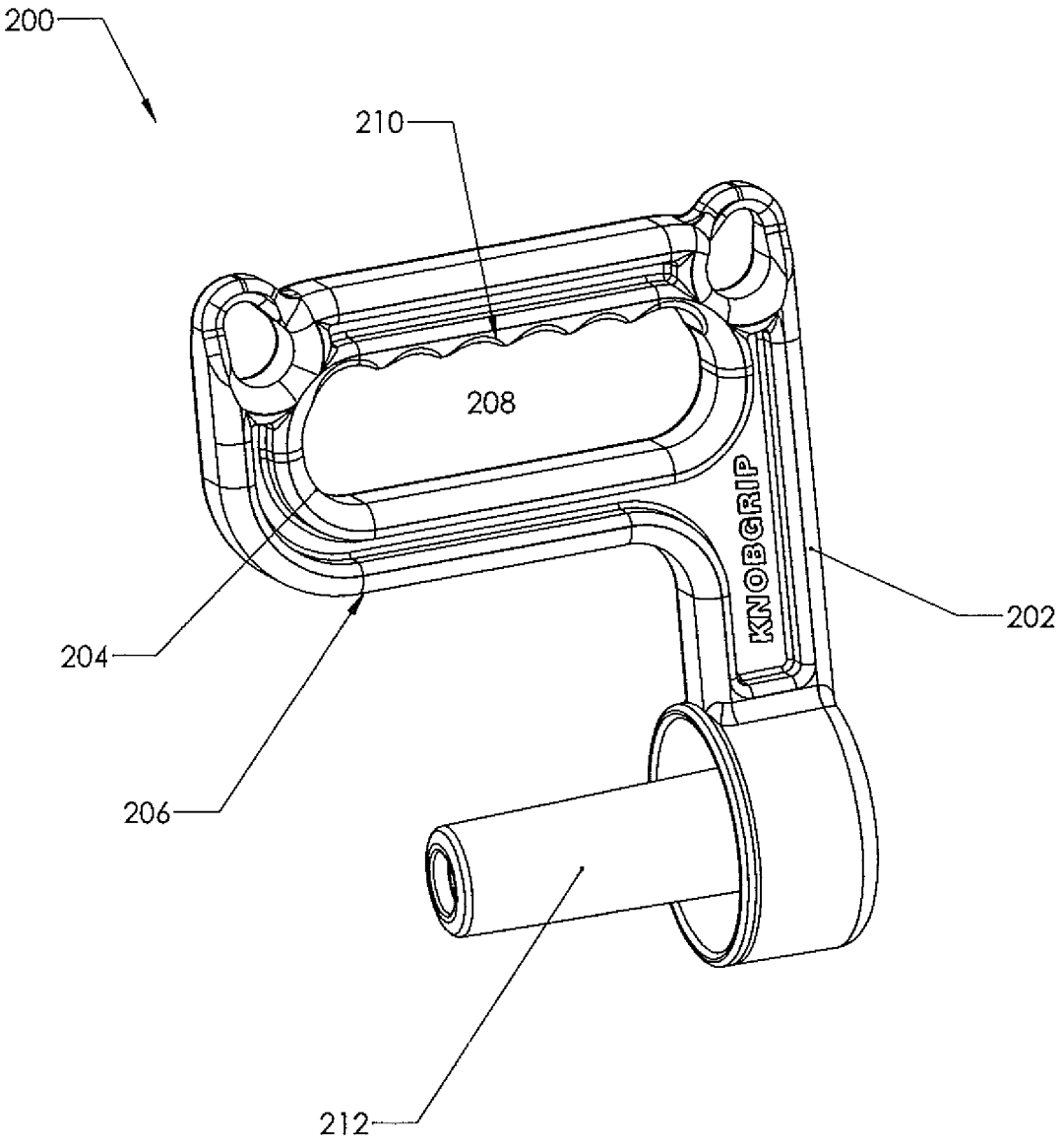
FIG. 16 is a rear view of the carrying device used with the light source device with an end cap removed.
Figure 17:
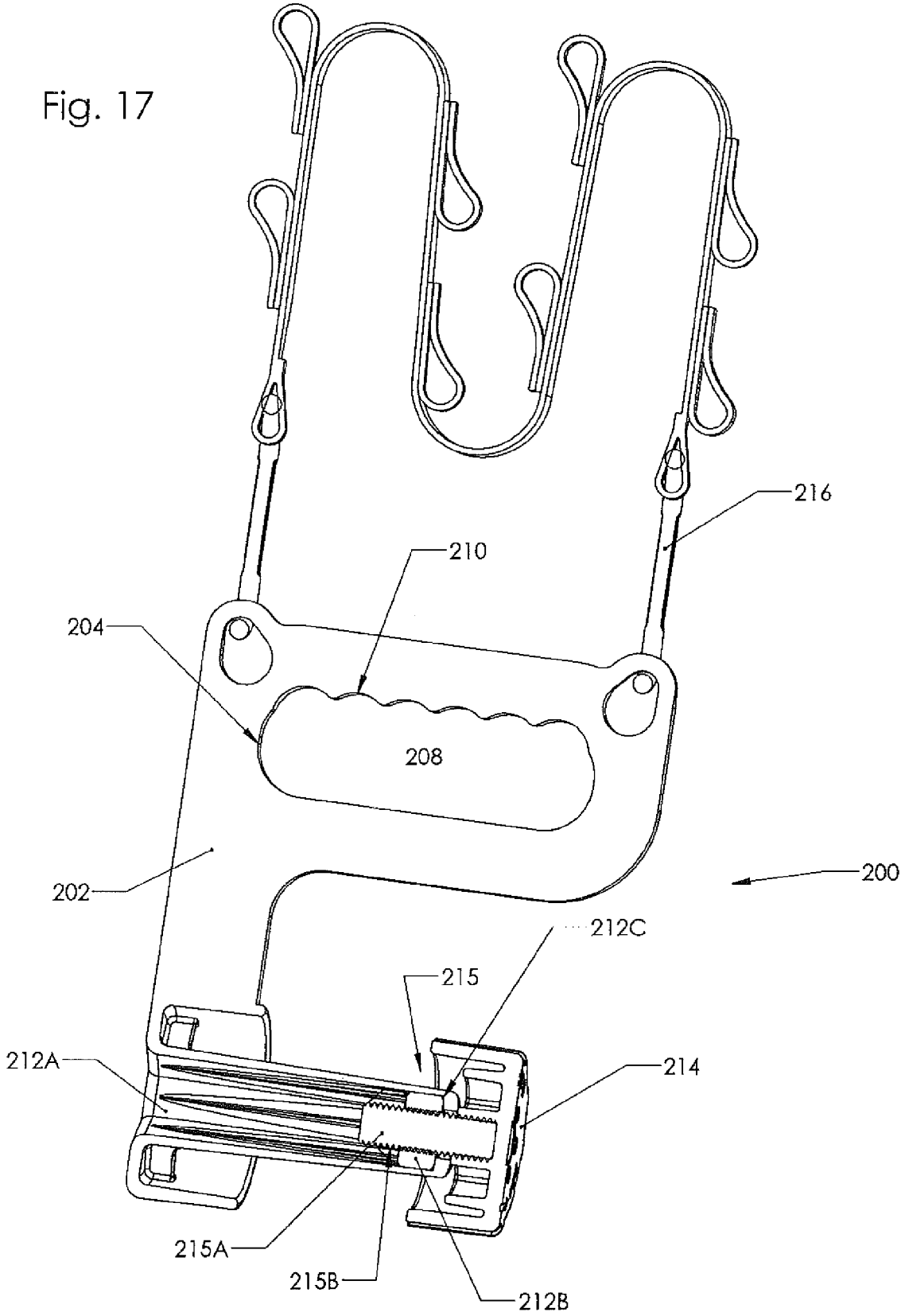
FIG. 17 is a cross-sectional view of the carrying device used with the light source device.
Figure 18:
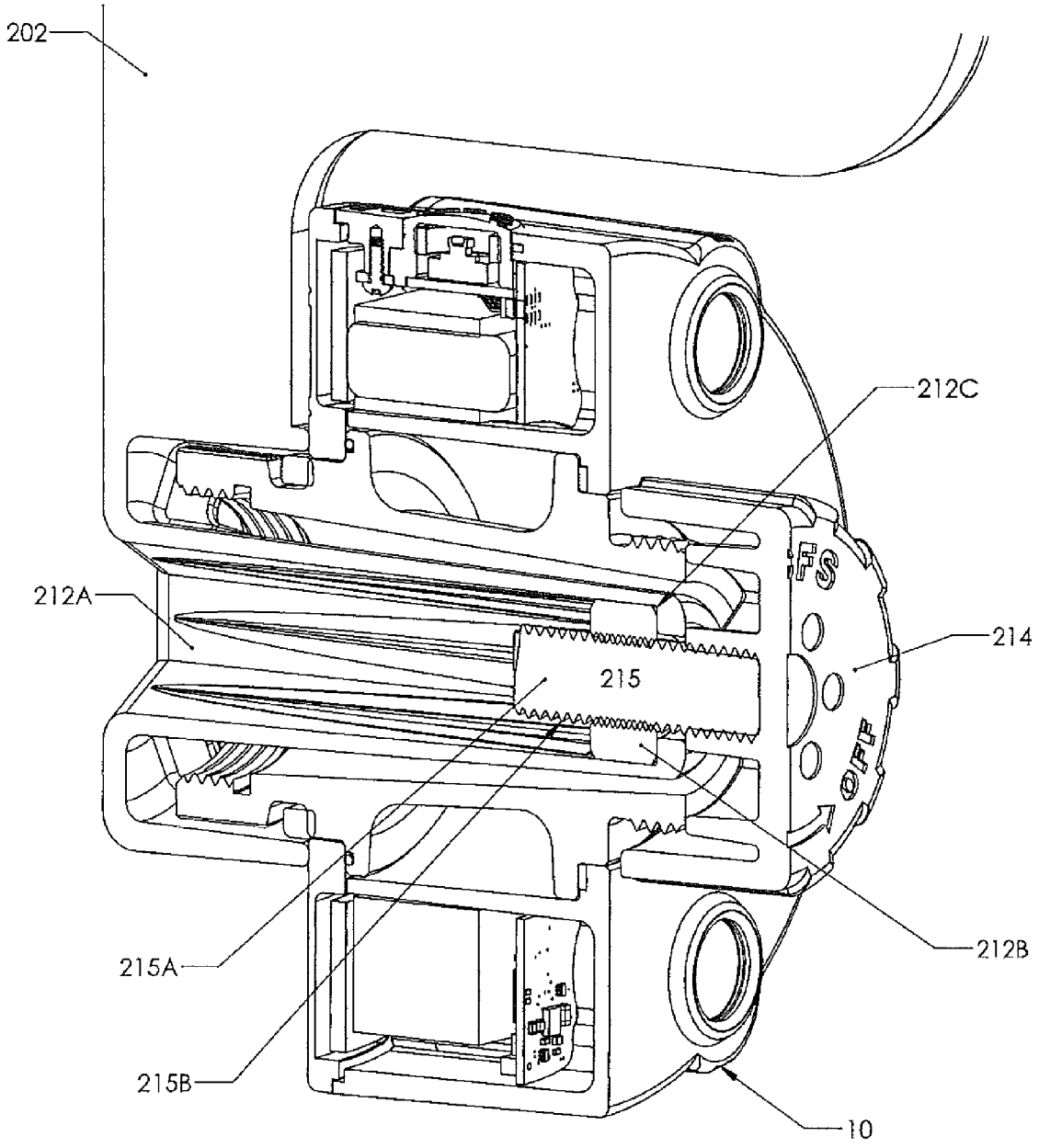
FIG. 18 is a magnified cross-sectional view of the carrying device used with the light source device with the light source device attached.
Figure 19:
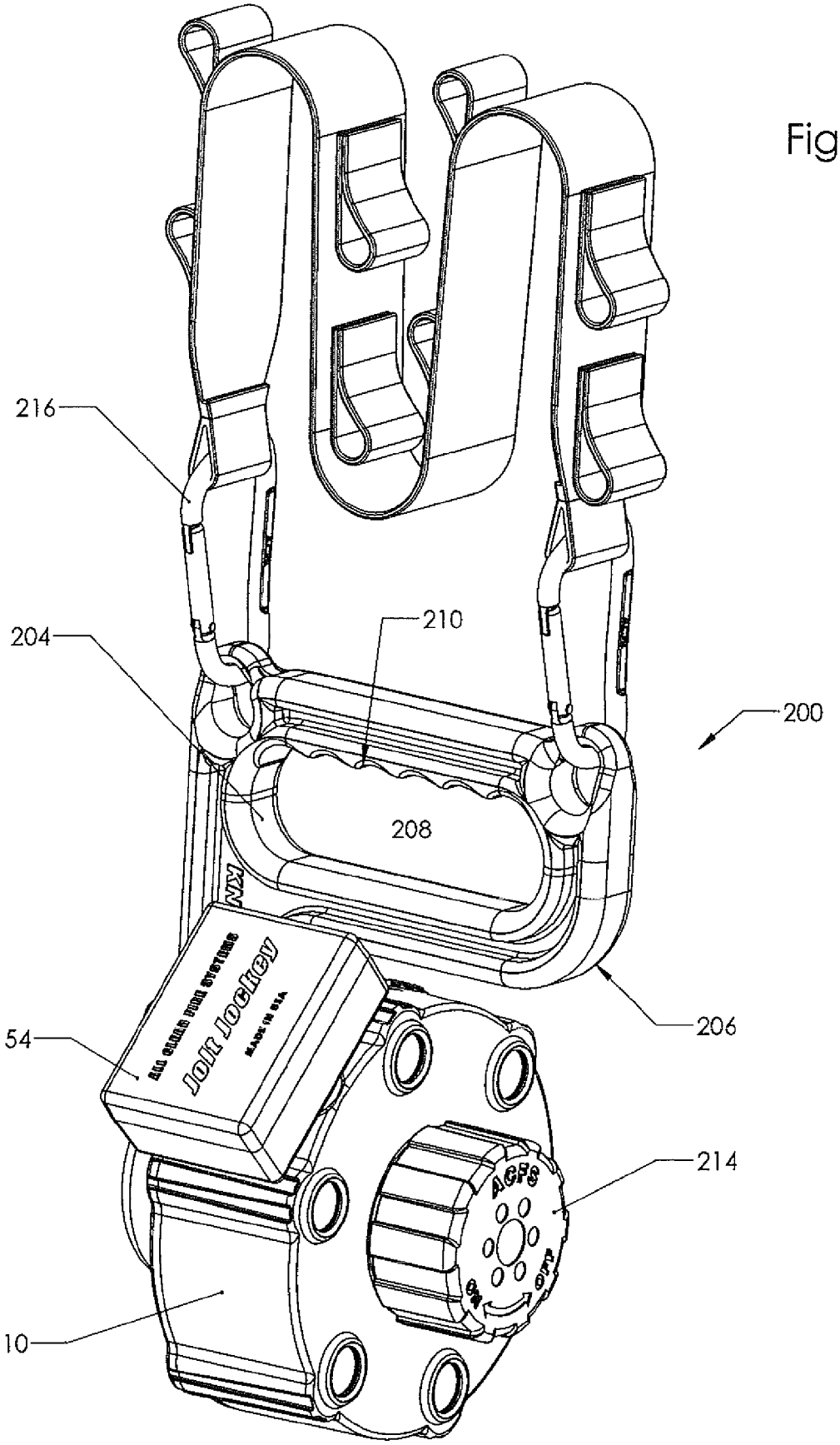
FIG. 19 is a perspective front view of a carrying device used with the light source device with the light source device attached.
Figure 20:
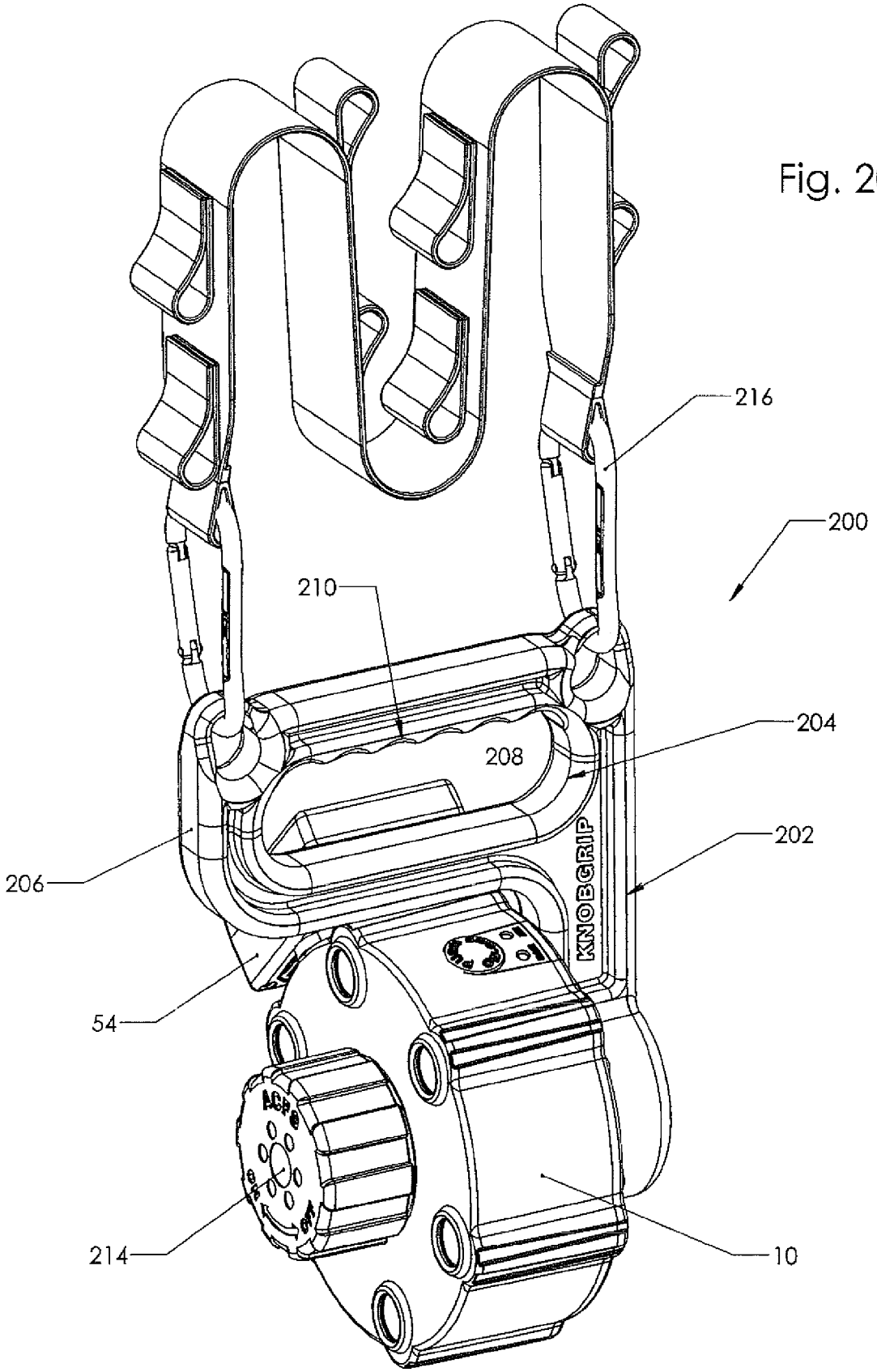
FIG. 20 is a perspective rear view of a carrying device used with the light source device with the light source device attached.

The device 10 may be mounted on other items beside a fire nozzle 60 and fire hose coupling 62. Referring now to FIG. 13, the device 10 is shown coupled to a fire engine water cannon 199. As stated above, since the plurality of lighting and video fixtures 14 are positioned around an outer perimeter of the housing 12, the lighting and video fixtures 14 may be directed to illuminate the extinguishing agent exiting the device 10. This helps firefighters determine if the extinguishing agent exiting the device 10 is being properly directed in the right area/location to extinguish the fire. Under conditions where the refractive index of the illuminated stream is higher than that of the surrounding environment, water flowing through air, for example, the fluid stream captures and contains the light much as an optical fiber does, permitting the light to flow with the stream, through clouds of particulates and combustion gases without suffering the high degree of scattering that would otherwise occur. This illuminated fluid can facilitate easier application with water/foam in limited visibility environments on the fire scene. The UV components of the light emitted by the lighting and video fixtures 14 are also of utility in illuminating the scene without back scattering (glare) in the visible spectrum. UV light emitted does scatter in the smoke, but such scatter is invisible to the human eye such that fluorescent and phosphorescent objects within the smoke-filled environment, including reflective sections on fire fighters' turnout gear, provide visual cues and references to the fire fighter.

Referring now to FIGS. 14-20, a carrying unit 200 is shown. The device 200 may be used to carry an apparatus for discharging a fire extinguishing agent such as a fire hose, fire hose nozzle, fire hose couplings, water discharge outlet on a fire engine, water discharge outlet on a fire ladder truck, or the like. The device 200 will be described below for carrying the device 10 disclosed above. However, this should not be seen in a limiting manner.

The carrying unit 200 may be used with the device 10 to allow one to easily remove and move the device 10 from a hose. The carrying unit 200 is generally formed of a lightweight and fire resistant material.

The carrying unit 200 may be formed of a frame member 202. The frame member 202 may have a handle 204 formed on a top section of the frame member 202. In accordance with one embodiment of the present invention, the handle member 204 may be formed of a tab 206 which extends out and away from the top section of the frame member 202. An opening 208 may be formed in the tab 206. The opening 208 may allow a user to insert his/her hand in the tab 206 to lift/carry the carrying unit 200. A plurality of indentations 210 may be formed around a top section of the perimeter of the opening 208. The indentations 210 may be used as finger grips to allow the user to more comfortably lift/carry the carrying unit 200.

A bottom leg member 212 may extend out and away from a bottom section of the frame member 202. The bottom leg member 212 may be cylindrical in shape. The bottom leg member 212 may be sized to allow the bottom leg member 212 to be inserted through pipe 50 positioned through the housing 12 thereby allowing the carrying unit 200 to be coupled to the device 10 in order to carry the device 10. In accordance with one embodiment, a distal end of the bottom leg member 212 may be slightly tapered. This may allow one to more easily insert the bottom leg member 212 through pipe 50. In order to decrease the weight of the carrying unit 200, the bottom leg member 202A may be entirely or partially hollow.

To secure the device 10 on the bottom leg member 212 an end cap 214 or locking device may be removably coupled to a distal end of the bottom leg member 212. The end cap 214 is sized to be larger than the opening of the pipe 50 of the device 10. This allows the end cap 214 to prevent the device 10 from sliding off the bottom leg member 212.

The end cap 214 may have a locking device 215 to removably couple the end cap 214 to the bottom leg member 212. The locking device 215 may take on a plurality of different forms. In accordance with one embodiment, the locking device 215 may be comprised of a rod member 215A that extends from a central area of the end cap 214. The rod member 215A may have threading 215B. The threading 215B may be used to engage threading 212A formed in a channel 212B formed in a closed distal end 212C of the bottom leg member 212. The above is given as one example and should not be seen in a limiting manner. Other devices/methods may be used to removably couple the end cap 214 to the bottom leg member 212 without departing from the spirit and scope of the present invention.

One or more carabineers 216 may be coupled to the carrying unit 200. The carabineers 216 may be coupled at different locations on the carrying unit 200. In accordance with one embodiment, the carabineers 216 may be coupled to the handle member 204. The carabineers 216 may be used to attach the carrying unit 200 to a user. In accordance with one embodiment, a strap may be attached to the carabineers 216 to allow one to carry the carrying unit 200.

While embodiments of the disclosure have been described in terms of various specific embodiments, those skilled in the art will recognize that the embodiments of the disclosure may be practiced with modifications within the spirit and scope of the claims.

What is claimed is:

1. A device for carrying an apparatus for discharging a fire extinguishing agent comprising:

a frame member;

a leg member extending out and away from a bottom section of the frame member, the leg member dimensioned to be inserted through an opening formed in the apparatus;

an end cap removably coupled to the leg member for securing the apparatus to the device; and a locking device for removably securing the end cap to the leg member, wherein the locking device comprises a rod member extending from the end cap and threading formed on the rod member and wherein the threading formed on the rod member engages threading formed on a closed distal end of the leg member.

2. The device for carrying an apparatus for discharging a fire extinguishing agent in accordance with claim 1, further comprising a handle formed on a top section of the frame member.

3. The device for carrying an apparatus for discharging a fire extinguishing agent in accordance with claim 2, wherein the handle comprises:

a tab member formed the top section of the frame member; and an opening formed through the tab member, the opening configured to allow a hand of a user to be inserted through the opening.

4. The device for carrying an apparatus for discharging a fire extinguishing agent in accordance with claim 3, wherein the handle further comprises indentations formed in the opening.

5. The device for carrying an apparatus for discharging a fire extinguishing agent in accordance with claim 3, further comprising at least one carabineer coupled to the device.

6. A device for carrying an apparatus for discharging a fire extinguishing agent comprising:

a frame member;

a handle formed on a top section of the frame member;

a leg member extending out and away from a bottom section of the frame member, the leg member dimensioned to be inserted through an opening formed in the apparatus;

an end cap removably coupled to the leg member for securing the apparatus to the device; and a locking device for removably securing the end cap to the leg member, the locking device comprising a rod member extending from the end cap and threading formed on the rod member, wherein the threading formed on the rod member engages threading formed on a closed distal end of the leg member.

7. The device for carrying an apparatus for discharging a fire extinguishing agent in accordance with claim 6, wherein the handle comprises:

a tab member formed the top section of the frame member; and an opening formed through the tab member, the opening configured to allow a hand of a user to be inserted through the opening.

8. The device for carrying an apparatus for discharging a fire extinguishing agent in accordance with claim 7, wherein the handle further comprises indentations formed in the opening.

9. The for carrying an apparatus for discharging a fire extinguishing agent in accordance with claim 6, further comprising at least one carabineer coupled to the device.

* * * * *